US005667207A

United States Patent [19]

Pistole

[11] Patent Number: 5,667,207

[45] Date of Patent: Sep. 16, 1997

[54] MULTI-PURPOSE WORK STATION ASSEMBLY

[76] Inventor: James M. Pistole, P.O. Box 144, US 41, Jasper, Fla. 32052-0144

[21] Appl. No.: 369,183

[22] Filed: Jan. 5, 1995

[51] Int. Cl.[6] ..... B66F 3/00

[52] U.S. Cl. ..... 269/17; 144/286.1; 269/69; 248/676

[58] Field of Search ..... 269/16, 17, 69, 269/289 M; 144/286 R, 286 A, 286.1, 286.5, 287; 248/67, 677, 680, 681; 182/129, 181, 182

[56] References Cited

U.S. PATENT DOCUMENTS

| | | | |
|---|---|---|---|
| 2,814,099 | 11/1957 | Knittel | 269/17 |
| 2,827,690 | 3/1958 | Brown | 269/17 |
| 2,879,059 | 3/1959 | Sandefur | 269/17 |
| 4,258,907 | 3/1981 | Roberts et al. | 269/69 |
| 4,595,186 | 6/1986 | Reeb et al. | 269/69 |
| 4,838,199 | 6/1989 | Weber | 269/17 |
| 5,141,211 | 8/1992 | Adams, Jr. | 269/17 |
| 5,148,846 | 9/1992 | Van Gelder . | |

*Primary Examiner*—W. Donald Bray
*Attorney, Agent, or Firm*—Carnes, Cona and Dixon

[57] ABSTRACT

The present invention provides for a multi-purpose work station assembly that will aid and assist an individual who is working on a particular project and/or with a power tool. The multi-purpose work station assembly of the present invention consists of a base, a body, and a clamping assembly. The base can be adjusted in length and width and also includes a plurality of wheels to provide for the assembly to be mobile. The body attaches the clamping assembly to the base and is adapted to be adjusted in height. The clamping assembly is secured to the body and includes at least one clamping device. This clamping device receives and secures the item to be worked on within the work station assembly.

24 Claims, 5 Drawing Sheets

MULTI-PURPOSE WORK STATION ASSEMBLY

BACKGROUND OF THE INVENTION

1. Field of the Invention

The present invention relates generally to a multi-purpose work station and more particularly to a multi-purpose work station assembly that is used to assist and aid an individual who is working with various sizes of material.

2. Description of the Prior Art

Attempts have been made to eliminate the dangers and increase the efficiency when an individual is working with large pieces of materials or when an individual is working with a power tool for cutting wood. An individual cannot work the power tool and maintain the wood when the material is extremely large or has an awkward shape. When this situation occurs, a second person must be around to retain and maintain the material while the first person operates the power tool. This arrangement provides for an inefficient and time consuming means for cutting or working with wood and/or other materials. Attempts have been made to increase the safety and increase the efficiency of maintaining and cutting wood and/or other materials with a power tool.

For example, U.S. Pat. No. 5,148,846 issue to Van Gelder discloses a workpiece guide. The workpiece guide includes a yoke shape carrier having a knurled wheel attached thereto. The yoke shape carrier straddles the fence of a conventional table saw to permit for the knurled wheel to guide the wood to be cut. This arrangement provides for the workpiece guide to be retrofitted onto the conventional cutting machine. This arrangement will not be useful if the piece of wood to be cut is at least twice the length of the fence. Two people would be required to cut the wood. One would be used to operate the conventional saw while a second person would have to maintain the wood in an upright position and parallel to the floor.

None of these previous efforts, however, provide the benefits intended with the present invention. Additionally, prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention provides for a multi-purpose work station assembly that will aid and assist an individual who is working on a particular project and/or with a power tool. The multi-purpose work station assembly of the present invention consists of a base, a body, and a clamping assembly.

The base supports the multi-purpose work station assembly and includes an upper surface and a lower surface. The lower surface includes a plurality of wheels to provide for the assembly to be mobile. The base can be increased in length and width by an adjusting means. The body is adapted to be removably or pivotally secured to the upper surface of the base. This will provide for the body to be collapsible or removable with respect to the base.

The body extends outwardly from the upper surface of the base. The body includes a first end and a second end. The first end of the body is attached to the upper surface of the base while the second end is attached to the clamping assembly. The height of the body can be altered by a height adjusting means.

The clamping assembly includes a shaft which is perpendicular to the body. The shaft includes a first end, a second end, and a middle portion. The middle portion is attached to the body. The first end and the second end each include at least one clamping means. This clamping means can be adjusted to move linearly and vertically along the shaft. Additionally, the clamping means can also be rotated about the shaft in order to adjust the angle of the clamp with respect to the shaft.

In order to operate the multi-purpose work station assembly of the present invention, the clamping means receives an object. The clamping means is tightened to securely maintain the object. Once the object is in place, the user can adjust the angular position of the object in the clamping device by a rotational means. The height of the body can then be adjusted by the height adjusting means. The assembly can then be rolled to the desired location in order to permit for the appropriate action (i.e. sawing) to take place.

Accordingly, it is an object of the present invention to provide for a multi-purpose work station assembly that will safely, easily, and efficiently maintain an article of any shape or dimension.

It is yet another object of the present invention to provide for a multi-purpose work station assembly that is collapsible and mobile.

A further object of the present invention is to provide for a multi-purpose work station assembly that is adjustable in height, width, or number of clamping devices in order to accommodate for a variety of shapes and dimensions of articles and materials.

Still a further object of the present invention is to provide a multi-purpose work station assembly that will increase the work proficiency of an individual as well as permit for an individual to work independently and efficiently.

A final object of the present invention, to be specifically enumerated herein, is to provide a multi-purpose work station assembly in accordance with the preceding objects and which will conform to conventional forms of manufacture, be of simple construction and easy to use so as to provide an assembly that would be economically feasible, long lasting and relatively trouble free in operation.

Although there have been many inventions related to work station assemblies, none of the inventions have become sufficiently compact, low cost, and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
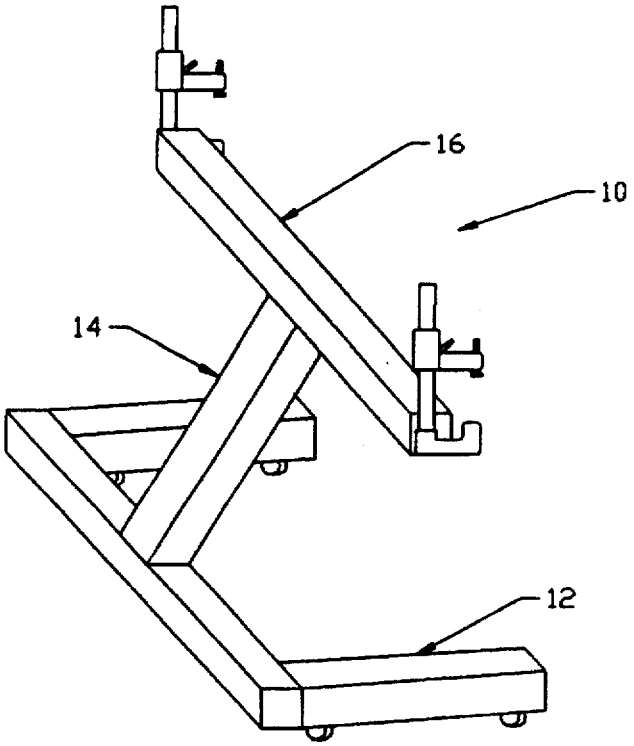
FIG. 1 is a perspective view of the multi-purpose work station assembly of the present invention.

FIG. 1 illustrates the perspective view of the multi-purpose work station assembly of the present invention. As illustrated in the figure, the multi-purpose work station assembly 10 includes a base 12, a body 14, and a clamping assembly 16.

Figure 2:
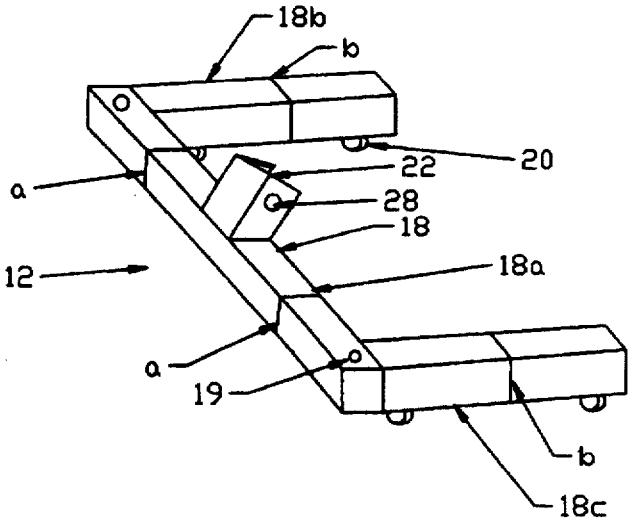
FIG. 2 is a perspective view of the base used in the multi-purpose work station assembly of the present invention.

The base 12 is illustrated in further detail in FIG. 2. The shape of the base can include a plurality of designs. However, it has been discovered that a U-shape base has produce excellent results. Other shapes that can be used include, but not be limited to circular, cross, or rectangular. The use of the U-shape base provides for the opened portion of the base to receive the power tool or work area. This arrangement will permit for the present invention to operate closely to the conventional power tool or work area.

As seen in this figure, the base 12 includes a top surface 18 and a bottom surface (not labeled). Attached to the bottom surface are a plurality of wheels 20. These are conventional wheels and each wheel includes a brake (not illustrated) for securing the multi-purpose works station assembly in a locked and stabled position. Centrally located on the top surface 18 of the base is a stud 22. This stud 22 receives the body of the assembly of the present invention. The body is collapsible and/or removable with respect to the base. The collapsible and/or removable means is illustrated and discussed in further detail in FIGS. 3*a* and 3*b*.

The base 12, illustrated in this preferred embodiment having a U-shape configuration, can be adjusted in length and width by and an adjusting means. As illustrated in this figure the length can be adjusted at point a and the width can be adjusted at point b. The adjusting means is illustrated in further detail in FIGS. 4*a* and 4*b*.

The base 12 further includes a main shaft **18*a* that is perpendicular to two side shafts 18*b* and 18*c*, respectfully. Optionally, each side shaft 18*b*, 18*c* is pivotally mounted and is rigidly secured in a spread apart opened position by a wing nut and bolt 19. This will provide for the side shaft to be folded towards the main shaft. In order to fold the side shafts 18*b* and 18*c* towards the main shaft, the wing nut is loosened and the side shafts are folded. The wing nut is tightened to secure the base in a folded and closed position. To reassemble, the wing nut 19 is loosened and the two side shafts 18*b*, 18*c* are pushed away from the main shaft 18*a*. Once the side shafts 18*b*, 18*c* are in a desired location, each wing nut 19** is tightened to lock the side shafts in a fixed position.

The use of foldable side shafts provides for an assembly that is compact and portable once the body is completely removed from the base.

Figure 3A:
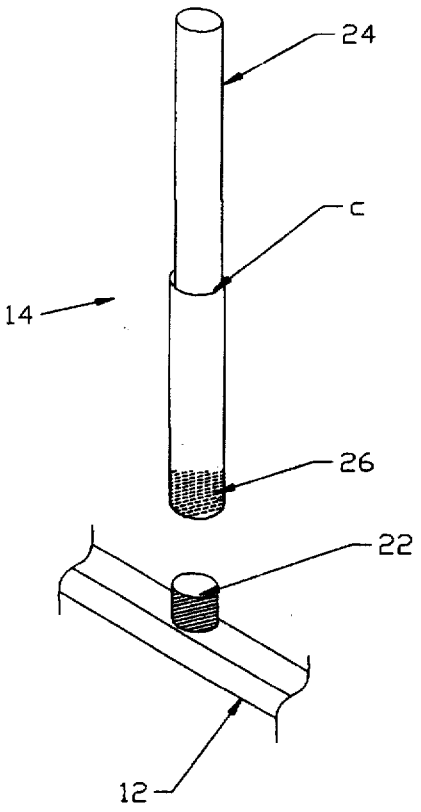
FIG. 3*a* is a perspective view of a first embodiment of the body of the multi-purpose work station assembly of the present invention.
Figure 3B:
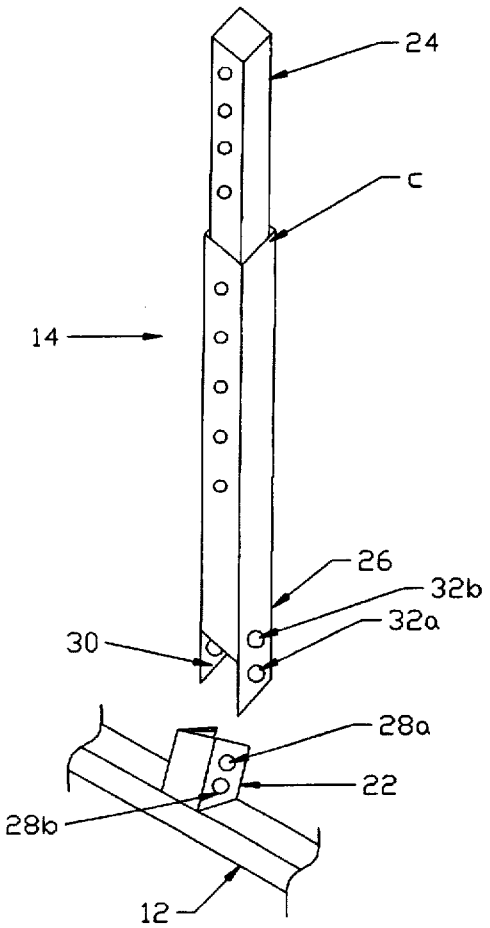
FIG. 3*b* is a perspective view of a second embodiment of the body of the multi-purpose work station assembly of the present invention.

The body 14 is illustrated in further detail in FIGS. 3*a* and 3*b*. The first embodiment for the body is illustrated in FIG. 3*a*. As shown, the body 14 includes a first end 26 and a second end 24. The first end 26 of the body 14 is adapted to be removably secured to the base 12. The second end 24 is attached to the clamping assembly. The securement of the first end 26 to the base can be accomplished by using a threaded stud 22. To enable releasable attachment to the stud 22, the first end 26 of the body 14 is internally threaded. This configuration provides for the body 14 to be threadably secured to the top surface of the base 12. In this embodiment the stud and shaft have a circular cross-section.

A second means to removably secure the body to the base is illustrated in FIG. 3*b*. In this embodiment, the body includes a first end 26 and a second end 24. The first end is secured to the clamping assembly and the second end is secured to the base 12. The second end 26 further includes an opened side wall 30 (or opened area). The stud 22 includes a first aperture **28*a* that extends horizontally therethrough. The stud further includes a second aperture 28*b* that extends horizontally therethrough and is parallel to the first aperture 28*a*. A first set of holes 32*a* extends through the body 14. This first set of holes are located at opposite sides and are aligned with each other. A second set of holes 32*b*, extends through the body 14** and are located at opposite sides and are aligned with each other. In this arrangement, a cotter key or a pin would be inserted into or removed from the each set of holes and each aperture in order to removably attached the first end of the body to the base.

In the embodiment illustrated in FIG. 3*b*, the cotter keys or pins would be removed to permit for the body 14 to fold downward towards the base 12 in the direction of the opened side wall 30. Once the body 14 has collapsed, a cotter key or pin would be inserted into the first set of holes **32*a* and into the second aperture 28*b*** to provide for the device to be in a locked and stored position.

The stud illustrated FIGS. 3*a* and/or 3*b* can be perpendicularly attached to the base or the stud can also be attached to the base at an acute angle with respect to the base. It is noted that if the stud is attached at a right angle then the back of the base would be increased in length in order to allow for the center of gravity of the item to be maintained within the clamping assembly to be within the range of the base. This will prevent the assembly from tipping.

The second end 24 of the body 14 is secured to the clamping assembly to provide that the clamping assembly is parallel to the base 12. The body 14 can be adjusted in length at points c by an adjusting means. This adjusting means is similar to the adjusting means used with the base and is illustrated and discussed in further detail in FIGS. 4*a* and 4*b*.

The adjusting means, for adjusting the width of the base (points a in FIG. 2), the length of the base (points b in FIG. 2) and the height of the body (points c of FIGS. 3*a* and 3*b*) are similar. This adjusting means is illustrated in further detail in FIGS. 4*a* and 4*b*, the first and second embodiments for the adjusting means. The first embodiment of the adjusting means is shown in further detail in FIG. 4*a*. As seen in this figure, the adjusting means includes a sleeve 60 that is hollow and receives a hollow shaft 62. This provides for the shaft to slide freely within the sleeve. This first embodiment further includes for a first set of evenly spaced holes 64 to be located on the side of the sleeves and a second set of evenly spaced holes (also labeled as 64) to be located on the side of the shaft. Both set of holes extend completely through the sleeve and shaft. Once the desired width, length or height is obtained, and the holes are aligned, then a pin (not illustrated) is inserted into the holes to secure the shaft to the sleeve in a fixed position. It is noted that the first set of holes and the second set of holes can be threaded to permit for a screw like device to be inserted into the first and second set of threaded holes to provide for the screw like device to be threadably secured to the aligned holes.

Figure 4A:
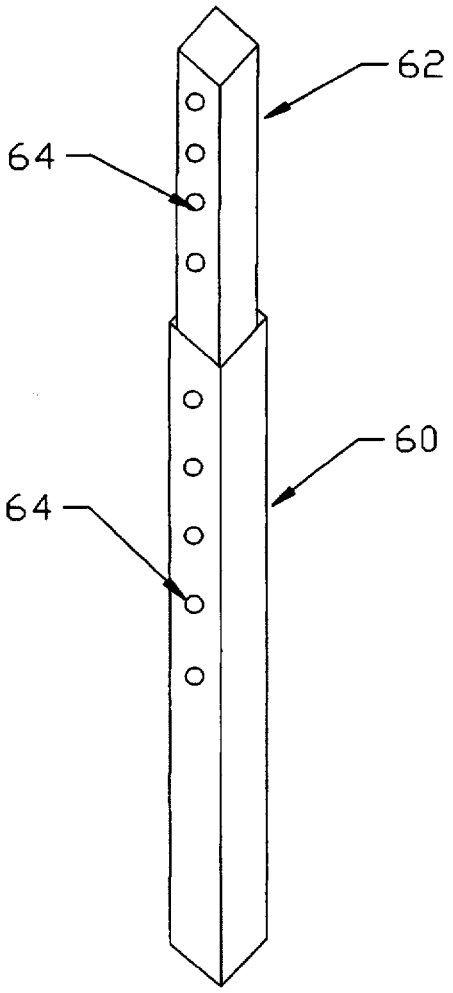
FIG. 4*a* is a perspective view of a first embodiment of the height adjusting means used in the body of the multi-purpose work station assembly of the present invention.
Figure 4B:
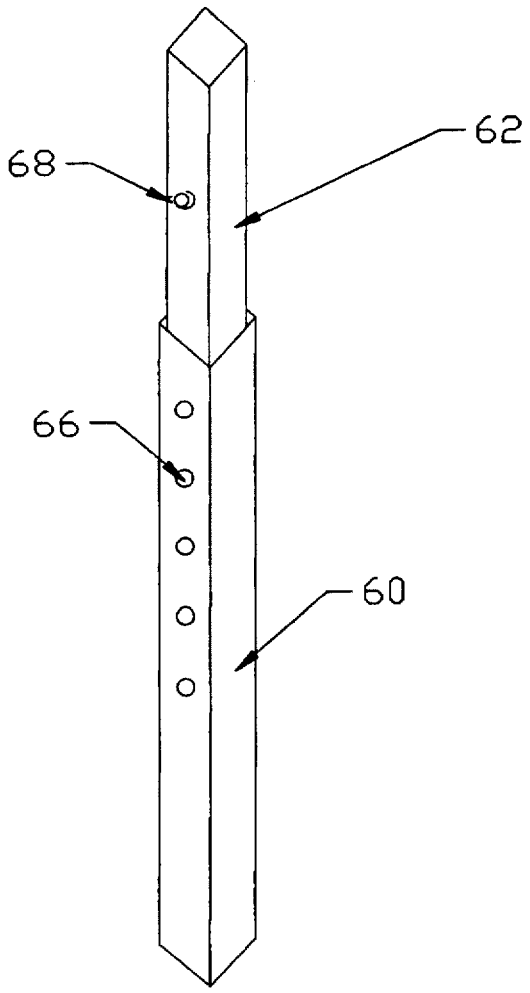
FIG. 4*b* is a perspective view of a second embodiment of the height adjusting means used in the body of the multi-purpose work station assembly of the present invention.

The second embodiment of the adjusting means is illustrated in FIG. 4*b*. As seen in this figure, the adjusting means includes a sleeve 60 that is hollow and receives a hollow shaft 62. This provides for the shaft to slide freely within the sleeve. This second embodiment further includes for a first set of evenly spaced holes 66 to be located on a side of the sleeve. A spring loaded button 68 is located on an end of the shaft 62. In order to adjust the width, length or height, the button 68 is pressed and the shaft slides freely within the sleeve. The button emerges at the first available hole located on the sleeve, thus locking the structure in a fixed position. If that width, length or height is not desired then the process is continued until the desired location is obtained.

Figure 5A:
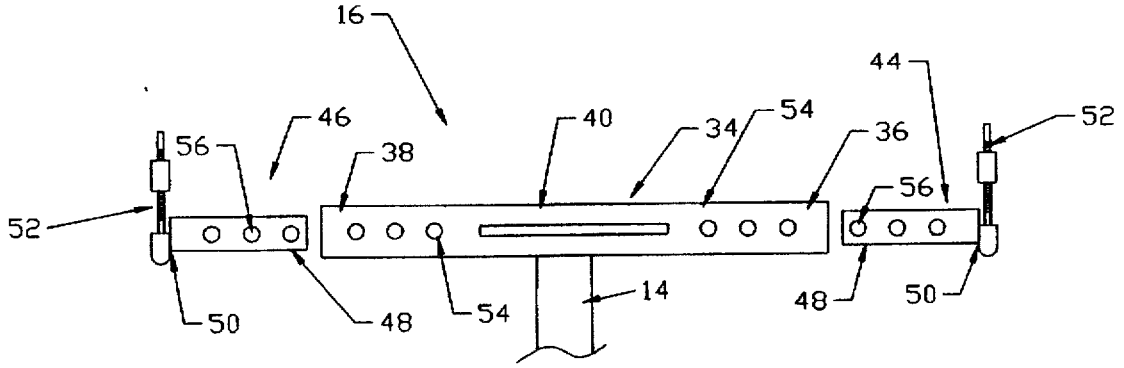
FIG. 5*a* is a frontal view of the clamping assembly of the multi-purpose work station assembly of the present invention.
Figure 5B:
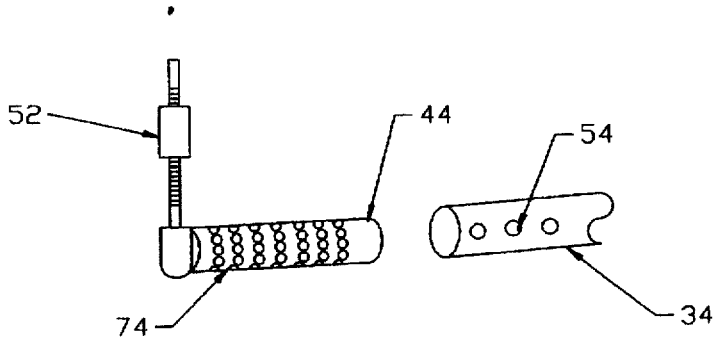
FIG. 5*b* a frontal view illustrating the rotational means of the clamping device with respect to the clamping assembly of the multi-purpose work station assembly of the present invention.
Figure 5C:
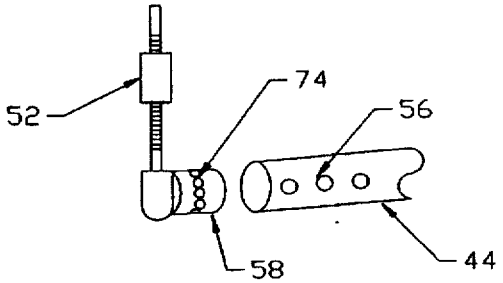
FIG. 5*c* is a frontal view illustrating the rotational means of the clamping device with respect to the clamping assembly of the multi-purpose work station assembly of the present invention.

The clamping assembly is illustrated in further detail in FIGS. 5*a*–5*c*. As shown, the clamping assembly 16 includes a main sleeve 34 that is attached to the body 14. The main sleeve 34 is hollow and includes a first end 36, a second end 38 and a middle area 40. Centrally located on the main sleeve 34 is a groove (illustrated but not labeled). This groove can be used to receive wide items (i.e. plywood or drywall) and to eliminate any possibility of the wide items from warping. A first extension 44 is received at the first end and the second extension 46 is received at the second end. These extensions are secured and removed from the main sleeve by an adjusting means. This adjusting means is similar to the adjusting means illustrated and discussed in further detail in 4*a* and 4*b*. As shown in this figure, the adjusting means consists of a first set of evenly spaced holes 54 which are located on the main sleeve 34 and a second set of evenly spaced holes 56 located on each extension 44. This will enable a cotter key or pin to be inserted in a hole of the first set and a hole of the second set once the desired location is obtained.

Each extension includes a first end 48 and a second end 50. The first end 48 of the first extension 44 is received in the first end 36 of the main sleeve. The second end of the first extension maintains a clamp device 52. The first end 48 of the second extension 46 is received in the second end of the main sleeve 34. The second end 50 of the second extension 46 maintains another clamping device 52.

The clamping devices 52 can be permanently attached to the first or second extensions as illustrated in FIG. 5*b* or the clamping devices can be adapted to be removable secured to each extension, as illustrated in FIG. 5*c*. In FIG. 5*b* it is shown that the clamping devices 52 are permanently attached (i.e. by welding) to the second end each extension 44 or 46. The extensions 44 or 46 can be secured to the main shaft by the adjusting means as illustrated in FIGS. 4*a* or 4*b* or the extension and the clamping means can also be adjusted to provide for an angular rotational alteration for the clamping devices. This alteration is illustrated and as shown includes a plurality of holes 74 to be evenly dispersed circumferentially and horizontally around and on the side wall of the extension. This arrangement will provide for the extensions 44 and 46 to include several rows of evenly and circumferentially dispersed holes. The main sleeve would includes a first set of evenly spaced holes 54. The holes would extend completely through the main sleeve and since the main sleeve is hollow this will provide for a first set of evenly spaced holes 54 (illustrated) and a second set of evenly spaced holes (not illustrated) to be located opposite to the first set of holes. The first set of holes is aligned with the second set of holes. Accordingly, to adjust the angular location of the clamping device 52, the extension would be rotated until a desired position is obtained. Once obtained, a cotter key or pin is inserted into the aligned holes located on the extension and on the main sleeve to secure the clamping device in a fixed position.

The clamping device can be attached to a holding mechanism 58 as illustrated in FIG. 5*c*, to provide for the clamping device 52 to be adjusted angularly with respect to the extensions 44 or 46. This arrangement, as shown in this figure, will provide for the holding mechanism 58 to include an angular rotational alteration. As seen this alteration includes a first set of holes 74 to be evenly dispersed circumferentially around and on the side wall of the holding mechanism 58. The extensions 44 and 46 would each include a first set of evenly spaced holes 56. The holes would extend completely through the extensions and since the extensions are hollow this will provide for a first set of evenly spaced holes 56 (illustrated) and a second set of evenly spaced holes (not illustrated) to be located opposite to the first set of holes. The first set of holes 56 is aligned with the second set of holes. Accordingly, to adjust the angular location of the clamping device 52, the holding mechanism 58 would be rotated until a desired position is obtained. Once obtained, a cotter key or pin is inserted into the aligned holes located on the holding mechanism and the extension to secure the clamping device in a fixed position.

It is noted that the main sleeve, extension, and holding mechanisms are not limited in shape to a circular cross-section and that any shape can be utilized. Accordingly, the main sleeve, extension, and holding mechanism can include a triangular, square, or any polygonal cross section.

Figure 6:
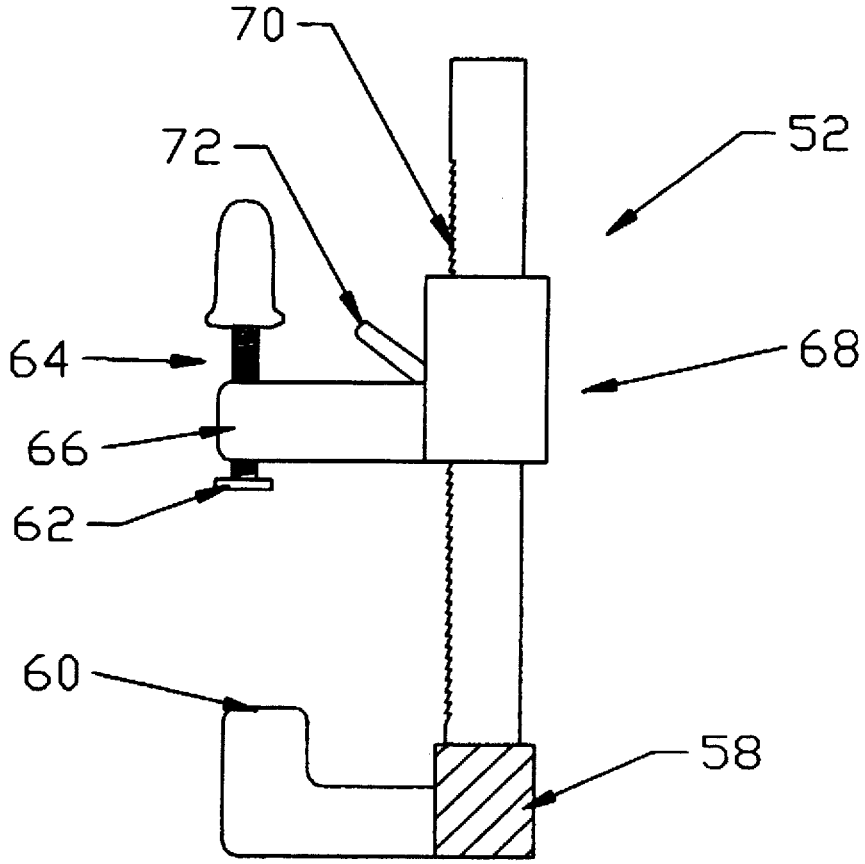
FIG. 6 is a side view of the clamping device used with the clamping assembly of the multi-purpose work station assembly of the present invention.

The clamping device is illustrated in further detail in FIG. 6. As seen in this figure, the holding mechanism 58 is attached to the side wall (as illustrated) or back of the clamping device 52. This clamping device further includes a first holding end 60 that remains stationary and a second holding end 62 that is movable about a shaft 70 via the sliding device 68. This sliding device is movable about the shaft 70 when the release mechanism 72 is held in an opened position. Upon release of the release mechanism (close position), the mechanism 72 will catch on one of the teeth of the shaft 70 to secure the sliding device 68 in a fixed position. The sliding device further include the movable holding end 62. This sliding device provides for a threaded aperture (not illustrated) to extend through an extension 66 of the sliding device 68. A threaded rod having a handle at one end (illustrated but not labeled) and the holding end 62 at its opposite end extend through the threaded through hole. This will permit for the movable holding end 62 to move axially about the through hole of the extension 66. In order to use the clamp, the appropriate adjustments take place (i.e. adjusting the movable sliding device). An item is placed on or within the stationary end 60 while the movable end 62 is guided towards the item. Once a secure contact of the movable end to the item is made, then the multi-purpose work station can be utilized.

It is noted that the clamping devices used are not limited to the clamping device illustrated in FIG. 6 and that other clamping devices can be used. For example, though not separately illustrated, the clamping device can include a plurality of devices that are horizontally aligned with one another. This will permit for a plurality of clamping devices to be used at one time.

While the invention has been particularly shown and described with reference to an embodiment thereof, it will be understood by those skilled in the art that various changes in form and detail may be made without departing from the spirit and scope of the invention.

I claim:

1. A multi-purpose work station assembly comprising:

a base that is attached to a first end of an elongated body;

said clamping assembly includes at least one clamping device attached thereto;

said base is in a U-shape structure having a main portion and a first side portion perpendicular to said main portion and a second side portion perpendicular to said main portion and said first side portion is parallel to said second side portion;

said base further includes a top surface and a bottom surface and said body;

said body is attached to said top surface centrally on said main portion and a plurality of wheels are attached to said bottom surface;

said main portion of said base can be adjusted in width and said first side portion and said second side portions can be adjusted in width and said first side portion and said second side portions can be adjusted in length by a first adjusting means.

2. A multi-purpose work station as in claim 1 wherein said first side portion is pivotally secured to said main portion for enabling said first portion and said second portion to be folded towards said main portion when said work station is not utilized.

3. A multi-purpose work station as in claim 1 wherein said clamping assembly includes a hollow main sleeve that is attached to said body, said main sleeve includes a first end, a second end, and a middle area, a first extension is received at said first end and a second extension is received at said second end, said first extension and said second extension are removably secured to said main sleeve by an adjusting means, and said first extension maintains a first clamping device and said second extension maintains a second clamping device.

4. A multi-purpose work station as in claim 1 wherein said clamping assembly includes a hollow main sleeve that is attached to said body, said main sleeve includes a first end, a second end, and a middle area, a first extension is received at said first end and a second extension is received at said second end, said first extension and said second extension are removably secured to said main sleeve by a second adjusting means, and each extension maintains said clamping device.

5. A multi-purpose work station as in claim 3 wherein a groove is located in said middle area of said main sleeve to enable wide items to be receive in said groove.

6. A multi-purpose work station as in claim 3 wherein said first extension and said second extensions are rotatably attachable to said main sleeve by a rotating means.

7. A multi-purpose work station as in claim 3 wherein said first clamping device is removably attachable to said first extension by a first holding mechanism and said second clamping device is removably attachable to said second extension by a second holding mechanism.

8. A multi-purpose work station as in claim 7 wherein said first holding mechanism and said second holding mechanism are rotatably attachable to said first extension and said second extension, respectfully, by a rotating means, said rotating means consists of a plurality of evenly spaced holes disperse circumferentially and horizontally through each of said first holding mechanism and said second holding mechanism;

said first extension and said second extension each are hollow and include a first set of evenly and horizontally spaced apertures and a second set of evenly and horizontally spaced apertures;

said first set of evenly and horizontally spaced apertures are aligned with said second set of evenly and horizontally spaced apertures;

a first cotter key or pin is adapted to extend into said first holding mechanism and said first extension via said first set of evenly and horizontally spaced apertures in said first extension, said holes in said first holding mechanism, and said second set of evenly and horizontally spaced apertures in said first extension; and a second cotter key or pin is adapted to extend into said second holding mechanism and said second extension via said first set of evenly and horizontally spaced apertures in said second extension, said holes in said second holding mechanism, and said second set of evenly and horizontally spaced apertures in said second extension.

9. A multi-purpose work station as in claim 1 wherein said body can be adjusted in height via an adjusting means.

10. A multi-purpose work station assembly comprising:

a base that is attached to a first end of an elongated body;

a clamping assembly is attached to a second end of said elongated body;

said clamping assembly includes at least one clamping device attached thereto; and a groove is horizontally disposed within said clamping assembly for enabling wide items to be received in said groove; and said base can be adjusted in width by a first adjusting means.

11. A multi-purpose work station as in claim 10 wherein said base includes a plurality of wheels secured to a lower surface of said base for providing said base to be mobile.

12. A multi-purpose work station assembly as in claim 10 wherein said at least one clamping device includes a holding end and said holding end faces away from said clamping assembly.

13. A multi-purpose work station as in claim 12 wherein said elongated body is secured with respect to said base at an acute angle to provide for said elongated body to extend outwardly from said base.

14. A multi-purpose work station as in claim 12 wherein said at least one clamping device is rotatably mounted to said clamping assembly via a rotating means.

15. A multi-purpose work station as in claim 12 wherein said clamping assembly includes a first clamping device and a second clamping device.

16. A multi-purpose work station as in claim 15 wherein said first clamping device is rotatably mounted to said clamping assembly via a first rotating means and said second clamping device is rotatably mounted to said clamping assembly via a second rotating means.

17. A multi-purpose work station as in claim 16 wherein said first rotating means operates independently from said second rotating means.

18. A multi-purpose work station as in claim 12 wherein said at least one clamping device can be displaced and adjusted horizontally on said clamping assembly via an adjusting means.

19. A multi-purpose work station as in claim 15 wherein said first clamping device can be adjusted horizontally on said clamping assembly via a first adjusting means and said second clamping assembly can be adjusted horizontally on said clamping assembly via a second adjusting means.

20. A multi-purpose work station as in claim 16 wherein said first clamping device can be adjusted horizontally on said clamping assembly via a first adjusting means and said second clamping assembly can be adjusted horizontally on said clamping assembly via a second adjusting means.

21. A multi-purpose work station as in claim 20 wherein said base can be adjusted in width via a third adjusting means.

22. A multi-purpose work station as in claim 12 wherein said body can be adjusted in height via an adjusting means.

23. A multi-purpose work station assembly comprising:

a base that is attached to a first end of an elongated body;

a clamping assembly is attached to a second end of said elongated body;

said clamping assembly includes at least one clamping device;

said clamping assembly includes a hollow main sleeve that is attached to said body;

said main sleeve includes a first end, a second end, and a middle area;

a first extension is received at said first end;

a second extension is received at said second end;

said first extension and said second extension are removably secured to said main sleeve by an adjusting means;

said first extension maintains a first clamping device and said second extension maintains a second clamping device; and a groove is located in said middle area of said main sleeve to enable wide items to be receive in said groove.

24. A multi-purpose work station as in claim 23 wherein said first extension and said second extensions are rotatably attachable to said main sleeve by a rotating means.

* * * * *